US008939302B2

(12) United States Patent
Last et al.

(10) Patent No.: US 8,939,302 B2
(45) Date of Patent: Jan. 27, 2015

(54) CLOSURE ASSEMBLY

(75) Inventors: Laurens Last, Bosch en Duin (NL); Peter Jan Van Der Molen, Den Haag (NL); Jeroen Gerrit Anton Gebbink, Brussels (BE)

(73) Assignee: IPN IP B.V., Houten (NL)

( * ) Notice: Subject to any disclaimer, the term of this patent is extended or adjusted under 35 U.S.C. 154(b) by 0 days.

(21) Appl. No.: 13/876,422

(22) PCT Filed: Sep. 28, 2011

(86) PCT No.: PCT/NL2011/050656

§ 371 (c)(1),
(2), (4) Date: May 16, 2013

(87) PCT Pub. No.: WO2012/044166

PCT Pub. Date: Apr. 5, 2012

(65) Prior Publication Data

US 2013/0299495 A1 Nov. 14, 2013

(30) Foreign Application Priority Data

Oct. 1, 2010 (NL) ..... 2005438

(51) Int. Cl.
*B65D 41/34* (2006.01)
*B65D 75/58* (2006.01)

(52) U.S. Cl.
CPC ..... *B65D 41/34* (2013.01); *B65D 41/3447* (2013.01); *B65D 75/5883* (2013.01); *B65D 2101/0046* (2013.01)
USPC ..... 215/252; 222/153.06; 222/541.5; 222/541.6

(58) Field of Classification Search
USPC ..... 215/252; 222/153.05, 153.06, 541.5, 222/541.6
See application file for complete search history.

(56) References Cited

U.S. PATENT DOCUMENTS 3,463,341 A * 8/1969 Fields ..... 215/252
4,534,479 A * 8/1985 Conti ..... 215/252
5,056,675 A 10/1991 Julian

FOREIGN PATENT DOCUMENTS

DE 102007029541 A1 1/2009
WO 03004361 A2 1/2003

OTHER PUBLICATIONS

International Search Report and Written Opinion completed Jan. 9, 2012 for priority application PCT/NL2011/050656.

* cited by examiner

*Primary Examiner* — Fenn Mathew
*Assistant Examiner* — James N Smalley
(74) *Attorney, Agent, or Firm* — Troutman Sanders, LLP; Ryan A. Schneider

(57) ABSTRACT

A closure assembly comprises an article (1) forming a tubular neck (2) around a product passage (3) in said article. The neck forms a mouth at a top end of said product passage. The assembly further comprises a rotational cap (20) that is injection molded of plastic material and that is secured on or to be secured on said neck of the article. The cap seals the product passage in closed position of the cap on said neck, and the cap—for removal of the cap from the neck of the article by a user to open the product passage—is adapted to be manually rotated from the closed position in an opening direction.

18 Claims, 3 Drawing Sheets

CLOSURE ASSEMBLY

BENEFIT CLAIMS

This application is a US National Stage of International Application No. PCT/NL2011/050656, filed 28 Sep. 2011, which claims the benefit of NL 2005438, filed 1 Oct. 2010.

FIELD OF INVENTION

The present invention relates to a closure assembly.

Closure assemblies are known with a plastic screw cap that is screwed onto a neck, e.g. of a container. A tamper-evident ring is integrally formed as a part of the plastic screw cap.

BACKGROUND OF THE INVENTION

A closure assembly is known from U.S. Pat. No. 5,056,675 in the name of Sunbeam Plastics Corp.

DE 10 2007 029 541 discloses a closure assembly with a cap having a tamper-evident ring composed of two segments. A first end portion of each segment is connected to the skirt via a non-frangible connector. The second end portion is connected via a single integrally moulded frangible rod portion to an adjacent first end portion of the other segment. The neck of the spout has for each segment a rotation preventing boss that is engageable with a corresponding abutment face on the second end portion of the segment. Upon first time removal of the cap, the frangible rod portion breaks and evidences the removal of the cap.

OBJECT OF THE INVENTION

The present invention aims to provide an improved closure assembly, or at least to provide an alternative for known closure assemblies.

The present invention primarily aims to provide a closure assembly, wherein the tamper-evident function is very reliable, so that the frangible rod portions reliably break upon removal of the cap.

SUMMARY OF THE INVENTION

The present invention achieves one or more of the above-mentioned objects by providing a closure assembly wherein the second end portion of each segment is forked with an upper prong and a lower prong each extending in circumferential direction, each prong having an end face, and with the abutment surface between said prongs circumferentially offset from the end faces of the prongs. A frangible rod portion, preferably a single rod portion, extends between the end face of each prong and the adjacent first end portion of said other segment. Each prong has—seen in a radial plane of the closure assembly—a greater cross-section than the associated frangible rod portion. The rotation preventing boss extends into the opening between the upper and lower prongs when the cap is secured on the neck, so that upon rotating the cap in opening direction by the user from its closed position for the first time the abutment face contacts said boss and causes deflection of said segment as well as breaking of the frangible rod portions, the prongs cooperating with the boss to retain the second end portion of the segment in vertical direction.

This arrangement causes a highly reliable functioning of the tamper-evident ring, in particular with respect to the breakage of the rod portions that provide the visible evidence of the removal of the cap. The arrangement operates reliable even when the segments are rather flexible, which allows for a limited use of plastic material which is relevant for such mass-produced plastic caps.

The arrangement allows to cause breakage of said frangible rod portions on the basis of a very limited rotation of the screw cap from its closed position, so that the user experiences a rather immediate breakage of said rod portions when he starts to open the closure.

Preferably the frangible rod portions lie recessed inwards with respect to the outer face of the tamper-evident ring segments and recessed inwards with respect to the outer face of the rotation preventing boss. This protects the rods against premature breakage, e.g. during storage and transportation, handling of the closure assembly (e.g. on equipment sealing the assembly in a pouch), etc.

Preferably the tamper-evident ring has two semi-circular segments and the neck has two rotation preventing bosses at 180° angularly spaced locations. It will be appreciated that in particular larger diameter closures may benefit from a design with three, four or even more segments.

Preferably the article comprises a circumferential lower flange and a circumferential upper flange, said flanges each protruding outwardly and extending circumferentially around the neck, the lower and upper flanges being spaced apart. Preferably—with the cap secured on the neck in closed position thereof—the lower flange extends underneath the lower edge of the tamper-evidence ring, and the upper flange lies against the inner face of the tamper evident ring near the top thereof. In this manner the lower flange hinders or prevents the introduction of a tool underneath the tamper-evident ring segments when an attempt is made to open the cap without damaging the tamper-evident ring. The flanges also add in keeping the tamper-evident ring at the desired location when the cap is in closed position.

Preferably and as known in the art one or more cooperating angular cap positioning members are present on the neck and on the skirt that allow to secure the cap on the neck at relatively high speed, normally with automated equipment, the finally obtained closed position of the cap on the neck being such that the one or more rotation preventing bosses are received in their respective openings between the prongs of the forked ends of the segments of the tamper-evident ring.

Further preferred details of the inventive closure assembly are disclosed in the subclaims and in the description with reference to the drawings.

DETAILED DESCRIPTION OF EMBODIMENTS

Figure 1:
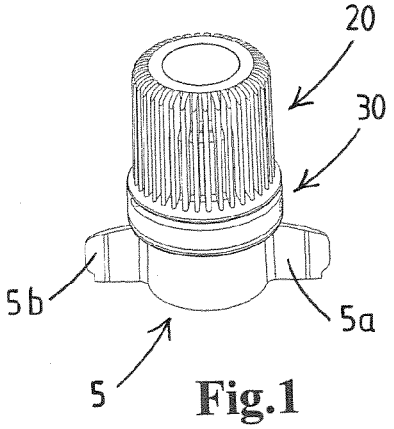
FIG. 1 shows a perspective view of an embodiment of the closure assembly according to the invention.
Figure 2:
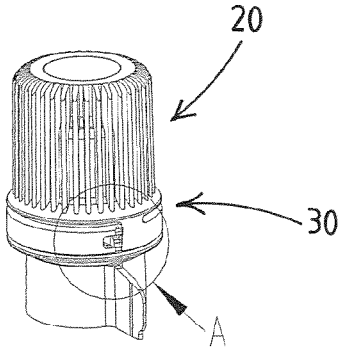
FIG. 2 shows the assembly of FIG. 1 in a different perspective.
Figure 3:
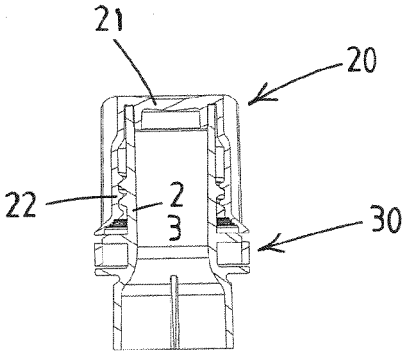
FIG. 3 shows a vertical cross-section of the assembly of FIGS. 1 and 2.
Figure 4A:
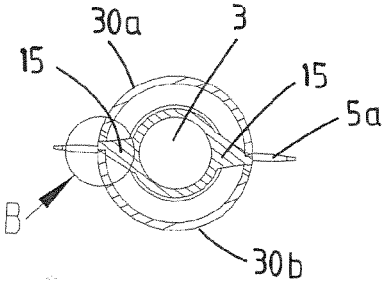
FIG. 4*a* shows a horizontal cross-section of the assembly of FIGS. 1 and 2 at the height of the rotation preventing bosses.
Figure 4B:
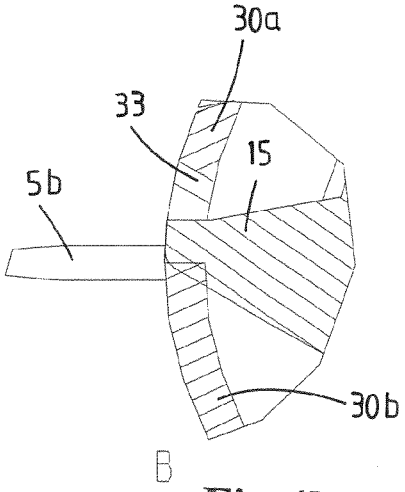
FIG. 4*b* shows detail B of FIG. 4*a* on a larger scale.
Figure 6:
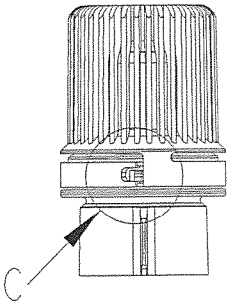
FIG. 6 shows a side view of the closure assembly.
Figure 5:
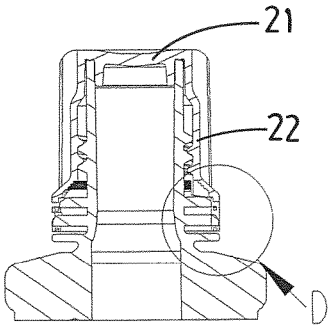
FIG. 5 shows a different vertical cross-section of the assembly of FIGS. 1 and 2.

With reference to FIGS. 1-9 now a preferred embodiment of the closure assembly according to the invention will be discussed.

Reference numeral 1 denotes an article forming a tubular neck 2 around a product passage 3 in the article. The neck 2 forms a mouth at a top end of the product passage. The neck 2 has an exterior side.

The article 1 here comprises a connector portion 5 to be fastened to a container (not shown, e.g. a collapsible pouch). In this example the article 1 is embodied as a spout with a connector portion that is adapted to be sealed between opposed film walls of a collapsible pouch container. The connector portion can have a different design, or even be absent, e.g. if the article is a container with an integral neck, e.g. a blow moulded bottle. The connector portion 5 here includes diametrically opposed fins 5*a*, 5*b* as is known in the art.

The tubular neck 2 here extends above the connector portion 5.

Reference numeral 20 denotes a rotational cap, preferably a screw cap, that is injection moulded of plastic material.

The cap 20 has been secured on the neck 2 of the article 1, the cap 20 sealing the product passage 3 in closed position of the cap on the neck. Here the cap 20 seals the product passage at the mouth at the top end of the product passage, but other designs, e.g. wherein sealing is at a distance below the mouth, are also possible.

The cap 20 is adapted to be manually rotated by a user from the closed position in an opening direction to allow for removal of the cap from the neck of the article by a user to open the product passage 3. The cap may be tethered to the article if desired.

The cap 20 comprises a top wall 21 and a downward depending skirt 22. The skirt 22 has an interior side, an exterior side, and a lower edge remote from the top wall 21.

The exterior side of the neck 2 and the interior side of the skirt 22 have cooperating rotational connection means, here first and second screw threads on the neck and skirt respectively.

The cap 20 furthermore comprises a tamper-evident ring 30 that is integrally moulded with the top wall 21 and the skirt 22 of the cap 20. The ring 30 is located below the skirt 21.

The tamper-evident ring 30 here is composed of a series of two segments 30*a*, 30*b*. Each segment 30*a, b* is connected via a non-frangible connector portion 30*c* to the skirt 22 at a first end portion of the segment. Each segment is connected at its second end portion, remote from the first end, via integrally moulded frangible rod members 40, 41 to an adjacent first end portion of another segment of the tamper-evident ring.

If desired one or more additional frangible bridges may be present between the segment and the skirt of the cap, e.g. extending between the top edge of the segment and the underside of the skirt of the cap.

The exterior side of the neck 2 has for each segment 30*a, b* of the tamper-evident ring a rotation preventing boss 15, here—as is preferred—a single boss per segment 30*a, b*. This boss 15 is engageable with a corresponding abutment face on the segment as will be explained below. The boss has, as is preferred, a ramp face facilitating the screwing of the cap onto the neck without breakage of the rods 40, 41. The boss has, as is preferred, a stop face that comes into abutment with an abutment surface on the segment.

The cap 20 with integrally moulded tamper-evident ring 30 has been secured on the neck via a rotational securing motion, the tamper-evident ring 30 with the frangible rod portions 40, 41 remaining intact during said securing motion.

Figure 7:
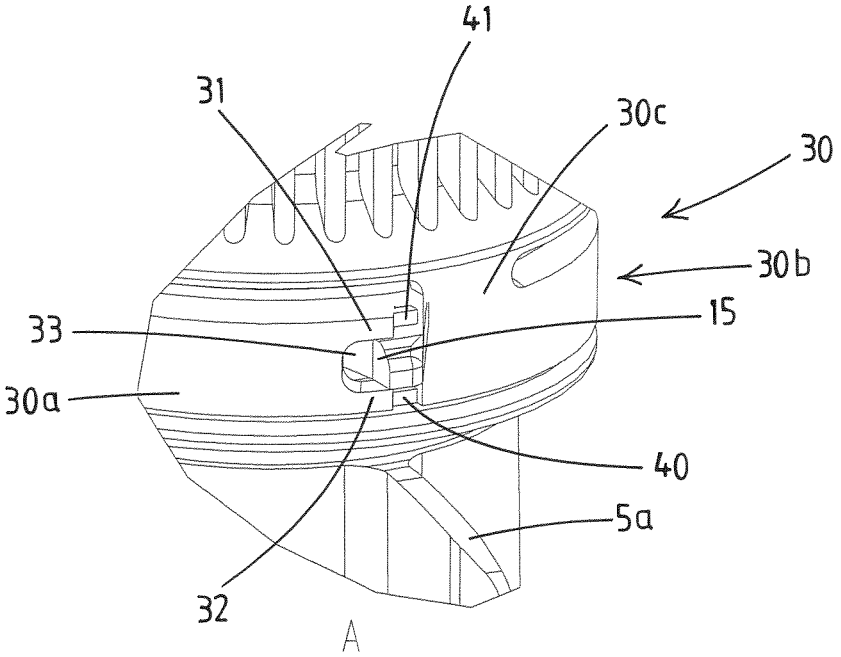
FIG. 7 shows detail A of FIG. 2 on a larger scale.
Figure 8:
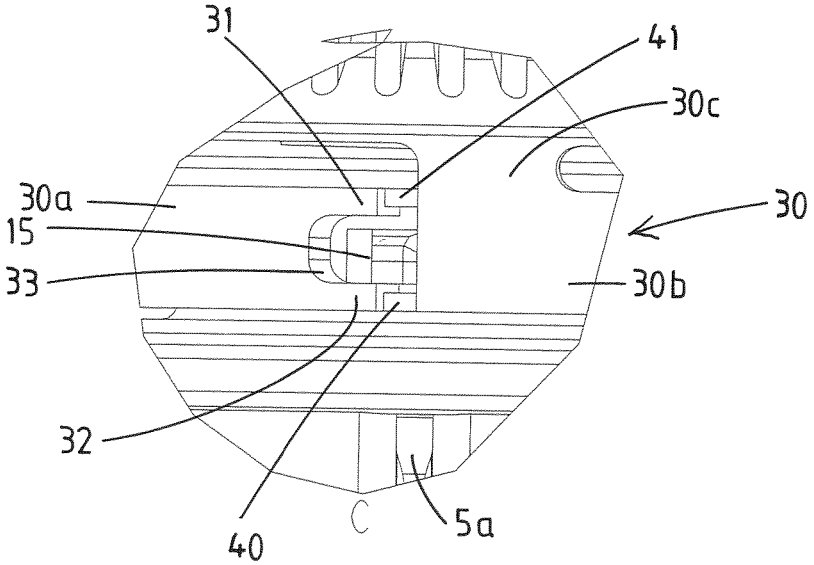
FIG. 8 shows detail C of FIG. 6 on a larger scale.
Figure 9:
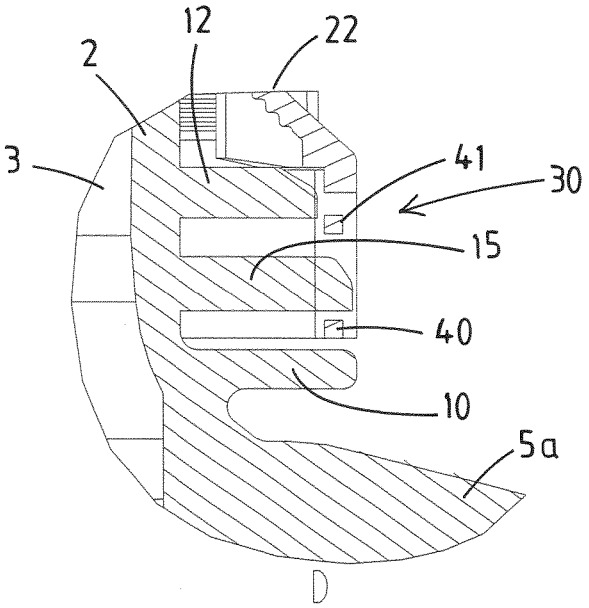
FIG. 9 shows detail D of FIG. 5 on a larger scale.

As can be seen best in FIGS. 7, 8 and 9 the second end portion, or forward end portion when seen in opening direction of the cap, of each segment 30*a, b* is forked with an upper prong 31 and a lower prong 32, each prong extending in circumferential direction. Each prong has an end face and the abutment surface 33 lies between the prongs 31, 32 circumferentially offset from the end faces of the prongs.

A frangible rod portion 41, 40, as is preferred a single rod portion, extends between the end face of each prong 31, 32 and the adjacent first end portion of the neighboring segment. As is preferred the rod portions lie in a horizontal plane.

Each prong 31, 32 has seen in a radial plane of the closure assembly—a greater cross-section than the associated frangible rod portion 41, 40. Preferably the cross-sections have a ratio of at least 1.5:1. This allows for a relative sturdy design of the prongs when compared to the rather weak rod portions, with the result that the prongs can serve their retaining purpose for the second end of the segment during the opening of the closure, whereas the rod portions 40, 41 break easily and quickly.

As can be seen—with the cap secured in closed position on the neck—the rotation preventing boss 15 extends into the opening between the upper and lower prongs 31, 32. As is preferred the cap is in said position held in place by non-shown angular cap positioning members which are present on the neck and on the skirt as is known in the art.

Upon rotating the cap in opening direction by the user from its closed position for the first time the abutment face 33 contacts the boss 15 rather immediately and continued rotation by the user causes deflection of the segment (e.g. in the form of an outwardly bowed arc compared to its original shape) as well as breaking of the frangible rod portions 40, 41. In this process the prongs 31, 32 cooperate with the boss 15 to retain the second end portion of the segment at least in vertical direction so that the segment can not come free from the boss without breakage of the rod portions.

As is preferred the frangible rod portions 40, 41 lie recessed inwards with respect to the outer face of the tamper-evident ring segments 30*a, b* and recessed inwards with respect to the outer face of the rotation preventing boss 15 so that premature breakage (e.g. during transport and storage) is prevented.

It will be appreciated that here the tamper-evident ring has two segments and the neck has two rotation preventing bosses at 180° angularly spaced locations.

As is preferred the article comprises a circumferential lower flange 10 and a circumferential upper flange 12. These flanges each protrude outwardly and extending circumferentially around the neck 2, the lower and upper flanges being spaced apart.

With the cap 20 secured on the neck in closed position thereof, the lower flange 10 extends underneath the lower edge of the tamper-evidence ring 30, and the upper flange 12 lies against the inner face of the tamper evident ring near the top thereof.

As is preferred the article is a spout having a lower connector portion with two fins extending sideways in opposed directions, the rotation preventing bosses 15 generally lie in the plane through said fins 5*a,b*.

As will be appreciated the article 1 could be a product container having a container body, wherein possibly the neck 2 is integrally moulded with the container body. In the embodiment shown here, as in other possible embodiments, the article is a fitment to be secured to a container body.

The invention claimed is:

1. A closure assembly comprising:

an article forming a tubular neck around a product passage in said article, said neck forming a mouth at a top end of said product passage, said neck having an exterior side;

a rotational cap that is injection moulded of plastic material and that is secured on or to be secured on said neck of the article, the cap sealing the product passage in closed position of the cap on said neck, and the cap—for removal of the cap from the neck of the article by a user to open the product passage—being adapted to be manually rotated about an axis of rotation from the closed position in an opening direction;

wherein the cap comprises a top wall and a downward depending skirt, said skirt having an interior side, an exterior side, and a lower edge remote from the top wall, wherein the exterior side of the neck and the interior side of the skirt have cooperating rotational connection means, preferably first and second screw threads on said neck and skirt respectively, wherein the cap furthermore comprises a tamper-evident ring that is integrally moulded below the skirt, said tamper-evident ring comprising segments, each segment being connected via a non-frangible connector portion to the skirt at a first end portion of the segment, each segment being connected at its second end portion via integrally moulded frangible rod portions to an adjacent first end portion of another segment of the tamper-evident ring, wherein the exterior side of the neck has for each segment of the tamper-evident ring a rotation preventing boss, said boss being engageable with a corresponding abutment face on the segment, wherein the cap with integrally moulded tamper-evident ring has been or will be secured on the neck via a rotational securing motion, the tamper-evident ring and frangible bridge portions remaining intact during said securing motion, wherein the cap with tamper-evident ring is embodied such that upon rotating the cap in opening direction by the user from its closed position for the first time, the frangible rod portions between the segments of the tamper-evident ring break thereby evidencing the removal of the cap from the neck, wherein the second end portion of each segment is forked with an upper prong and a lower prong, each prong extending in circumferential direction, each prong having an end face, and with the abutment face between said prongs circumferentially offset from the end faces of the prongs, wherein a frangible rod portion extends between the end face of each prong and the adjacent first end portion of said other segment, wherein each prong has—seen in a radial plane of the axis of rotation of the closure assembly—a greater cross-sectional area than the associated frangible rod portion, and wherein the rotation preventing boss extends into the opening between the upper and lower prongs when the cap is secured on the neck, so that upon rotating the cap in opening direction by the user from its closed position for the first time the abutment face contacts said boss and causes deflection of said segment as well as breaking of the frangible rod portions, the prongs cooperating with the boss to retain the second end portion of the segment in vertical direction.

2. The closure assembly according to claim 1, wherein the frangible rod portions lie recessed inwards with respect to the outer face of the tamper-evident ring segments and disposed radially inwardly with respect to the outer face of the rotation preventing boss.

3. The closure assembly according to claim 1, wherein tamper-evident ring comprises two segments, and wherein the neck comprises two rotation preventing bosses at 180° angularly spaced locations.

4. The closure assembly according to claim 1, wherein the article comprises a circumferential lower flange and a circumferential upper flange, said flanges each protruding outwardly and extending circumferentially around the neck, the lower and upper flanges being spaced apart, and wherein—with the cap secured on the neck in closed position thereof—the lower flange extends underneath the lower edge of the tamper-evidence ring, and the upper flange lies against the inner face of the tamper evident ring near the top thereof.

5. The closure assembly according to claim 1, wherein the article is a container having a container body.

6. The closure assembly according to claim 1, wherein the article is a fitment to be secured to a container body.

7. The closure assembly according to claim 6, wherein the article is a spout having a lower connector portion with two fins extending sideways in opposed directions, and wherein the rotation preventing bosses generally lie in the plane through said fins.

8. The closure assembly according to claim 1, wherein the article is a container having a container body, and the neck is integrally moulded with the container body.

9. The closure assembly according to claim 1, wherein the article is a spout securable to a container body.

10. The closure assembly according to claim 9, wherein the spout has a lower connector portion to be secured between opposed film walls of a collapsible pouch container.

11. A cap closure assembly comprising:

a tamper-evident ring comprising at least two segments, each segment having a first end portion, a second end portion and an abutment face;

upper and lower prongs each having an end face, the second end portion of each segment forked by an upper and lower prong, each prong extending in the circumferential direction, the abutment face between the prongs circumferentially offset from the end faces of the prongs;

a frangible rod portion extending between an end face of each prong and an adjacent first end portion of another of the at least two segments; and a rotation preventing boss extending into an opening between the upper and lower prongs when the cap closure assembly is secured on an article, so that upon rotating the cap closure assembly about an axis of rotation in an opening direction by a user from a closed position for the first time, the abutment face of a segment contacts the rotation preventing boss, causing deflection of that segment as well as breaking the frangible rod portion, the prongs cooperating with the rotation preventing boss to retain the second end portion of that segment in a vertical direction;

wherein each prong has—seen in a radial plane of the axis of rotation of the cap closure assembly—a greater cross-sectional area than the associated frangible rod portion.

12. The cap closure assembly of claim 11, comprising plastic material.

13. The cap closure assembly of claim 11 further comprising a top wall and a downward depending skirt, the skirt having an interior side, an exterior side, and a lower edge remote from the top wall.

14. The cap closure assembly of claim 13, wherein the tamper-evident ring is integrally molded below the skirt.

15. The cap closure assembly of claim 13, wherein each segment is connected via a non-frangible connector portion to the skirt at the first end portion of the segment.

16. The cap closure assembly of claim 15, wherein each segment is connected at its second end portion via integrally molded frangible rod portions to an adjacent first end portion of another segment of the tamper-evident ring.

17. The cap closure assembly of claim 15, wherein the cap closure assembly is securable upon an article with the tamper-evident ring and frangible rod portions intact prior to the cap closure assembly being moved in the opening direction by a user for the first time.

18. The cap closure assembly of claim 17, wherein upon rotating the cap closure assembly in the opening direction by a user for the first time, the frangible rod portions between the segments of the tamper-evident ring break, thereby evidencing removal of the cap closure assembly from an article.

* * * * *